US012281792B2

(12) United States Patent
Hänel et al.

(10) Patent No.: US 12,281,792 B2
(45) Date of Patent: Apr. 22, 2025

(54) METHOD FOR PURIFYING A RAW GAS STREAM AND PURIFICATION DEVICE

(71) Applicant: Dürr Systems AG, Bietigheim-Bissingen (DE)

(72) Inventors: Matthias Hänel, Hessigheim (DE); Christian Eichhorn, Sachsenheim (DE)

(73) Assignee: Dürr Systems AG, Bietigheim-Bissingen (DE)

( * ) Notice: Subject to any disclaimer, the term of this patent is extended or adjusted under 35 U.S.C. 154(b) by 903 days.

(21) Appl. No.: 17/291,948

(22) PCT Filed: Oct. 30, 2019

(86) PCT No.: PCT/DE2019/100937
§ 371 (c)(1),
(2) Date: May 6, 2021

(87) PCT Pub. No.: WO2020/094183
PCT Pub. Date: May 14, 2020

(65) Prior Publication Data

US 2022/0003412 A1 Jan. 6, 2022

(30) Foreign Application Priority Data

Nov. 8, 2018 (DE) ..... 102018219105.0

(51) Int. Cl.
*F23G 7/06* (2006.01)
*F23N 3/00* (2006.01)
*F28D 17/02* (2006.01)

(52) U.S. Cl.
CPC ..... *F23G 7/068* (2013.01); *F23G 7/061* (2013.01); *F23N 3/002* (2013.01); *F28D 17/02* (2013.01);

(Continued)

(58) Field of Classification Search
None
See application file for complete search history.

(56) References Cited

U.S. PATENT DOCUMENTS 4,338,199 A 7/1982 Modell
5,364,259 A 11/1994 Matros et al.
(Continued)

FOREIGN PATENT DOCUMENTS

AU 200132509 8/2001
CN 103868081 6/2014
(Continued)

OTHER PUBLICATIONS

International Searching Authority, "International Search Report and Written Opinion," issued in connection with International Application No. PCT/DE2019/100937, mailed on Feb. 27, 2020, 16 pages. Partial English translation included.
(Continued)

*Primary Examiner* — Daniel Berns
(74) *Attorney, Agent, or Firm* — Hanley, Flight & Zimmerman, LLC

(57) ABSTRACT

In order to provide a method for the purification of a raw gas stream containing water vapour that is simple and cost-efficient to perform, it is proposed that the method should comprise the following: feeding the raw gas stream to a reforming region in which contaminants in the raw gas stream react chemically with the water vapour in the raw gas stream, as a result of which a reformed raw gas stream is obtained; feeding the reformed raw gas stream and an oxidising agent stream to an oxidation region in which constituent parts of the reformed raw gas stream react chemically with oxidising agent of the oxidising agent stream, as a result of which a clean gas stream is obtained. Moreover, optionally a closed-loop control of the oxygen content is provided. Further, it is optionally provided for the (Continued)

clean gas stream to be fed to a condenser, as a result of which the volumetric flow of the clean gas stream is reduced and/or as a result of which energy can be recovered and used for pre-heating the oxidising agent and for other production processes.

16 Claims, 4 Drawing Sheets

(52) U.S. Cl.
CPC ..... *F23G 2201/40* (2013.01); *F23G 2206/10* (2013.01); *F23N 2241/18* (2020.01)

(56) References Cited

U.S. PATENT DOCUMENTS

| | | | |
|---|---|---|---|
| 5,460,789 | A | 10/1995 | Wilhelm |
| 5,650,128 | A | 7/1997 | Holst et al. |
| 6,014,863 | A | 1/2000 | Okusawa et al. |
| 7,332,136 | B2 | 2/2008 | Heed |
| 2010/0047639 | A1 | 2/2010 | Kluge et al. |
| 2010/0050629 | A1 | 3/2010 | Kluge |
| 2014/0013665 | A1 | 1/2014 | Baldauf et al. |
| 2014/0202206 | A1 | 7/2014 | Temple et al. |
| 2016/0305656 | A1 | 10/2016 | Wu et al. |

FOREIGN PATENT DOCUMENTS

| | | |
|---|---|---|
| DE | 19721712 | 12/1997 |
| DE | 10149807 | 4/2003 |
| DE | 102008000527 | 9/2008 |
| DE | 102011002612 | 7/2012 |
| EP | 0548630 | 6/1993 |
| EP | 1304526 | 4/2003 |
| EP | 1906088 | 4/2008 |
| JP | 2004209314 | 7/2004 |
| JP | 2007132611 | 11/2005 |
| WO | 9524590 | 9/1995 |
| WO | 0159367 | 8/2001 |
| WO | 0188436 | 11/2001 |
| WO | 2020094183 | 5/2020 |

OTHER PUBLICATIONS

Peckham et al., "Exhaust gas fuel reforming: Joint project with Johnson Matthey, Ford Motor Company, University of Birmingham," Cambustion, Feb. 23, 2015, Retrieved from the Internet: https://futurepowertrains.co.uk/2015/assets/downloads/presentations/mar-peckham.pdf [retrieved on Feb. 17, 2020], 23 pages.

METHOD FOR PURIFYING A RAW GAS STREAM AND PURIFICATION DEVICE

RELATED APPLICATION

This application is a National Phase of international application No. PCT/DE2019/100937 filed on Oct. 30, 2019, and claims the benefit of German application No. 10 2018 219 105.0 filed on Nov. 8, 2018, which are incorporated herein by reference in their entirety and for all purposes.

FIELD OF DISCLOSURE

The present invention relates to the field of purifying raw gas. In particular, the present invention relates to the purification of raw gas, in particular waste steam, containing water vapour and carrying organic contaminants, for the purpose of eliminating odour and/or converting exhaust gases. Further, the present invention relates to a purification device for carrying out a method for purifying raw gas/waste steam.

BACKGROUND

In particular for the purpose of eliminating odour, raw gas can be purified using thermal facilities, for example regenerative thermal oxidation facilities. However, this usually requires a high expenditure of energy in order to maintain the system temperatures required for a thermal purification of raw gas. This high expenditure of energy usually results from the fact that a separation procedure is frequently carried out first in order to separate water, with for example organic dust, in particular fat, oil and/or protein particles, from the raw gas. As a result, oxidisable substances of considerable calorific value are lost to the raw gas stream that is fed to the thermal facility for the purpose of purifying the raw gas, which reduces the efficiency of the thermal conversion. Moreover, the substances that arise during the separation procedure have to undergo complex post-treatment and/or be disposed of separately, as hazardous waste. If, by contrast, a separation procedure for pre-treatment of the raw gas is dispensed with, then in the course of the thermal conversion there is a possibility of substances sticking to, clogging or otherwise being deposited on a heat transfer material (heat exchange material, heat storage material), which may drastically shorten the operating life of the facility and/or significantly increase the cost of maintenance.

SUMMARY OF THE INVENTION

The object of the present invention is to provide a method for the purification of a raw gas stream containing water vapour, in particular waste steam with organic contaminants, that is simple and cost-efficient to perform.

According to the invention, this object is achieved in that the method comprises the following:

feeding the raw gas stream to a reforming region in which organic contaminants in the raw gas stream react chemically with the water vapour in the raw gas stream, as a result of which a reformed raw gas stream is obtained;

feeding the reformed raw gas stream and an oxidising agent stream to an oxidation region in which constituent parts of the reformed raw gas stream react chemically with oxidising agent of the oxidising agent stream, as a result of which a clean gas stream is obtained.

Preferably, the organic contaminants in the raw gas stream react with the water vapour in the raw gas stream without an oxygen feed.

The contaminants are or comprise in particular liquid contaminants and/or solid contaminants and/or gaseous contaminants.

Because, in the method according to the invention, the raw gas stream is first reformed and only thereafter undergoes thermal conversion as a result of feeding oxidising agent, preferably air, fresh air, ambient air, oxygen-containing exhaust air, process exhaust air, etc., it is possible to use a calorific value within the raw gas stream, preferably during the oxidation, and thus enable thermal purification of raw gas that saves on fuel or is energy-saving in another way. Moreover, a method of this kind is preferably comparatively simple and low-cost because it is possible to dispense with a preceding separation step.

It may be provided for the clean gas stream to be fed to a heat exchanger, in particular a condenser, and for water vapour in the clean gas stream to be condensed by means of the heat exchanger, in particular by means of the condenser. As a result, in particular a volume and/or volumetric flow of the clean gas stream in the clean gas discharge line can be reduced, as a result of which ultimately an energy-efficient flow through the purification device may be achievable.

The chemical reaction in the reforming region is preferably an allothermal and/or hydrothermal gasification. A water-gas shift reaction, preferably in the first flow chamber, may be advantageous for the energy requirement of the vapour reformation.

As an alternative or in addition, it may be provided for the chemical reaction in the oxidation region to be a reaction with an external source of energy and/or an autothermal oxidation. Preferably, the water vapour of the raw gas stream containing water vapour serves as a gasification medium, in particular in the reforming region. A reaction with an external source of energy is preferably combustion.

The method may preferably be carried out with any thermally regenerative exhaust air purification facility. In particular, the inventive solution can be carried out not only with the embodiments of a purification device that are illustrated by way of example in the attached Figures but, rather, also with numerous variants of these.

For example, regenerator chambers that are arranged linearly may be provided as the flow chambers. Further, rotary facilities may be provided, in particular rotary slide devices according to EP 0 548 630 A1. It is also possible for the method to be preferably carried out on oxiders such as the product "Vocsidizer®" from MEGTEC SYSTEMS, INC., according to WO 01/88436 A1. Further, it is also preferably possible to provide for carrying out the method on one of the facilities disclosed in one or more of the printed specifications below: WO 01/59367 A1, AU 2001-232509 A1, WO 1995/024590 A1, EP 1 906 088 B1.

Reference is hereby explicitly made to all of the documents cited here, and their content is hereby incorporated into the subject matter of the present description.

It may be favourable if the method is carried out by means of a purification device that comprises a plurality of flow chambers, wherein a first of the flow chambers at least some of the time forms the reforming region, and wherein a second of the flow chambers at least some of the time forms a heat storage region to which the clean gas stream is fed.

Further, it may be provided for the purification device to comprise at least a third flow chamber that at least some of the time forms a pre-heating region to which the oxidising agent stream is fed for the purpose of being pre-heated before the oxidising agent stream is fed to the oxidation region.

It may be advantageous if the raw gas stream and/or the clean gas stream and/or the oxidising agent stream is/are fed cyclically/alternately in each case to different flow chambers, such that the flow chambers respectively alternately form the reforming region and/or the heat storage region and/or the pre-heating region.

Preferably, flow through the flow chambers is in different directions, depending on whether the respective flow chamber is forming a reforming region or a heat storage region.

In particular, a main direction of flow in a flow chamber when this forms a reforming region is opposed to a main direction of flow in the same flow chamber when it forms the heat storage region.

The flow chambers are preferably alternately heated and cooled, in particular being heated by means of the clean gas stream and/or being cooled by means of the raw gas stream and/or the oxidising agent stream.

Switchover of the flow paths is performed cyclically/alternately and/or is performed preferably on the basis of the energy balance of the heat storage regions, as known for example from patent specification EP 1 906 088 B1 (also known as the XtraBalance® method).

The flow chambers are preferably provided with a heat storage material, for example being filled at least in certain regions with a heat storage material.

The heat storage material preferably is or comprises a composition of different ceramic materials (for example material known under the trademark XtraComb®). The term "composition" should preferably also be understood to mean a layering of storage elements, storage bodies or storage blocks, wherein the storage elements, storage bodies or storage blocks are inhomogeneous, for example in planes or layers, in particular in the vertical composition or stack.

The heat storage material may in particular comprise or be formed from storage material that is dense-burned and/or smooth and/or highly porous and/or coated with a catalytic material and/or ceramic. Further, the heat storage material may preferably be a composition of dense-burned storage material and/or smooth storage material and/or highly porous storage material and/or storage material coated with a catalytic material and/or ceramic storage material.

It may be favourable if the raw gas stream has an oxidising agent content, in particular an oxygen content, of less than 5% by volume, in particular less than 3% by volume, preferably less than 1% by volume.

The raw gas stream is in particular waste steam.

Preferably, the raw gas stream is saturated with water vapour.

The raw gas stream is preferably fed to the reforming region without any addition of further media. In particular, preferably no gas stream containing oxidising agent is fed to the raw gas stream before the raw gas stream is fed to the reforming region.

In the reforming region, the raw gas stream is preferably heated to at least approximately 600° C., in particular at least approximately 750° C., for example at least approximately 800° C., particularly preferably at least approximately 850° C.

It may be provided for the raw gas stream in the reforming region and/or the clean gas stream in a heat storage region and/or the oxidising agent stream in a pre-heating region each to be guided through a respective heat storage unit of a heat storage device, wherein one or more or all of the heat storage units is formed by or comprises in particular ceramic flow bodies, for example moulded ceramic flow bodies.

The preferably porous surfaces of the ceramic flow bodies act in particular as acceleration factors for the allothermal and/or hydrothermal gasification.

Preferably, the heat storage units include catalytic materials, for example a catalytic coating and/or catalytically acting constituent parts.

Preferably here, the catalytic action always relates to reforming of the raw gas stream.

It may be provided for a heat exchanger and/or a heating device to be used to heat the raw gas stream before it is fed to the reforming region and/or to heat the oxidising agent stream before and/or after it is fed to a pre-heating region.

It may be favourable if a heating device is or comprises a burner, for example a gas and/or oil burner. As an alternative or in addition, the heating device may also comprise an electrical heating arrangement, for example an infrared heater, a resistance heater and/or similar. Here, heat transfer to the raw gas stream and/or the oxidising agent stream may take place directly, by feeding a heating gas stream, or indeed indirectly by way of a heat exchanger.

In particular, it may be provided for the raw gas stream and/or the oxidising agent stream to be heated to at least approximately 90° C., for example at least approximately 95° C., preferably at least approximately 100° C., in particular in order to avoid condensation of water in the region of the purification device, in particular the thermal exhaust air purification facility.

It may be advantageous if the clean gas stream is first fed to a heat storage region and then to a downstream heat exchanger, wherein the clean gas stream is cooled by means of the heat exchanger in particular sufficiently for condensate to form and as a result for heat that is still in the clean gas stream first to be transferred to the heat exchanger and/or made usable in some other way. It is advantageous for the energy requirement for conveying the raw gas stream and clean gas stream if the volumetric flow of the clean gas is preferably reduced as a result of the water vapour therein condensing out. In particular, it may preferably be provided for a negative pressure, below ambient pressure, to be produced in the condenser, as a result of which the energy requirement for conveying the raw gas stream and the clean gas stream for raw gas purification is reduced.

It may be advantageous if the oxidising agent stream is fed to the oxidation region such that it bypasses the reforming region and/or independently of a flow path of the raw gas stream.

In particular, the oxidising agent stream is preferably fed to the oxidation region by flowing through a flow chamber that is separate from the flow chamber forming the reforming region.

In one embodiment of the invention, it may be provided for the mass flow and/or the volumetric flow of the oxidising agent stream to be controlled by open and/or closed-loop control depending on a mass flow and/or volumetric flow of the raw gas stream and/or depending on an oxygen content in the outgoing clean gas stream. In particular, the closed-loop and/or open-loop control is performed such that a predetermined content of oxidising agent and/or a predetermined temperature are achieved in the oxidation region and/or in a clean gas discharge line.

The contaminants, in particular organic compounds, present in the raw gas stream are broken down and reacted in the reforming region, in particular by steam reforming. A reformed raw gas stream that is obtainable in this way comprises in particular gaseous oxidisable and/or organic substances such as hydrogen, methane and/or carbon monoxide.

In particular, the steam reforming takes place in at least one flow chamber, at a porous and/or ceramic surface of heat storage units.

Oxidising agent—in particular oxygen—that is where applicable still present in the raw gas stream can be used to supply some of the energy required for the steam reforming, in particular by partial oxidation of hydrocarbons, resulting for example in the production of carbon monoxide.

For example by means of a subsequent water-gas shift reaction, preferably further energy for the steam reforming, in particular steam reforming in the first flow chamber, may be supplied.

A major part of the activation energy required for the steam reforming is preferably supplied by heat storage material and/or a heat exchanger in the reforming region. In particular, the energy is provided by means of the heat storage units in the flow chambers, and for this purpose these are heated previously, in particular by heat transfer from the clean gas stream. Furthermore advantageous is the provision of energy from the steam reforming and/or the water-gas shift reaction.

In the method, in particular two, three or more than three flow chambers may be provided.

Preferably, at all times at least one flow chamber is flushed by means of the oxidising agent stream.

Preferably, at all times at least one flow chamber, preferably heat storage material therein, is heated by means of the clean gas stream.

Preferably, the heat from the heat storage material that is provided or present in at least one flow chamber is used by means of the raw gas stream.

In the oxidation region, preferably organic constituent parts of the raw gas stream react with the oxidising agent from the oxidising agent stream. Here, the water vapour content and the oxygen content—this last reduced by comparison with the ambient air—ensure that the thermal formation of nitrogen oxides is minimised. In the heat storage region to which the clean gas stream is preferably fed, reaction-accelerating heat storage material is preferably provided. This heat storage material, which increases surface areas, preferably enables a post-oxidation in the in particular upper heat storage region of the flow chambers, in order to convert residual contaminants that are still present in the clean gas stream, in particular substances that have not completely oxidised, and/or to render them harmless.

Heat that is removed from the clean gas stream by means of a heat exchanger may in particular be used for pre-heating process exhaust air and/or ambient air, in particular before they are fed as the oxidising agent stream. Condensate that is produced during this is preferably fed again to a production process.

A further object of the invention is to provide a purification device for the purification of a raw gas stream that is constructed simply and operable cost-efficiently.

According to the invention, this object is achieved by a purification device for the purification of a raw gas stream containing water vapour and having organic contaminants, wherein the purification device comprises the following:

a raw gas feed for feeding the raw gas stream to a reforming region of the purification device, in which organic contaminants in the raw gas stream react chemically with the water vapour in the raw gas stream, as a result of which a reformed raw gas stream is obtainable;

and an oxidising agent feed for feeding an oxidising agent stream to an oxidation region of the purification device, in which constituent parts of the reformed raw gas stream react chemically with oxidising agent of the oxidising agent stream, as a result of which a clean gas stream is obtainable.

The purification device according to the invention is particularly suitable for carrying out the method according to the invention.

The purification device preferably has individual or a plurality of the features and/or advantages described in connection with the method according to the invention.

Further, the method according to the invention may have individual or a plurality of the features and/or advantages described in connection with the purification device according to the invention.

Preferably, the purification device comprises a heat exchanger that is arranged in particular in the clean gas discharge line and is in particular a condenser. By means of the heat exchanger, in particular by means of the condenser, water vapour that is preferably in the clean gas stream is condensable. In particular, this makes it possible to reduce a volume and/or volumetric flow of the clean gas stream in the clean gas discharge line, as a result of which ultimately an energy-efficient flow through the purification device may be achievable. Preferably, a negative pressure, below ambient pressure, may be generated in the heat exchanger, in particular the condenser, as a result of which the energy requirement for conveying the raw gas stream and the clean gas stream for raw gas purification may be reduced.

It may be favourable if the purification device comprises a plurality of flow chambers, which are in particular provided with heat storage material, and an open-loop control device, wherein the purification device is configured to be put into different operating modes by the control device. In a first purification mode, the raw gas stream is configured to be fed, by means of the raw gas feed, preferably at least to a first of the flow chambers, and the clean gas stream is configured to be discharged, by means of a clean gas discharge line, from at least a second of the flow chambers. This mode preferably proceeds in a cyclically recurrent manner, in particular using all, but at least two, of the flow chambers.

Further, it may be provided for the control device to be configured to put the purification device into further operating modes, for example a second or third or fourth purification mode, in which further flow chambers are provided for the purpose of guiding through the raw gas stream and/or the clean gas stream.

Preferably, in at least one purification mode at least a third flow chamber is flushed. This at least one third flow chamber, to which the oxidising agent stream, in particular a fresh air stream, process exhaust air stream and/or process gas stream, is configured to be fed, preferably contains a preheating arrangement, in particular for heating the oxidising agent stream before this oxidising agent stream is fed to the heat storage region upstream of the oxidation region.

The purification device comprises in particular or forms a regenerative thermal oxidiser (RTO).

It may be advantageous if the purification device comprises a plurality of flow chambers through which the raw gas stream, the clean gas stream and/or the oxidising agent stream are configured to flow, wherein the flow chambers each comprise a heat storage unit.

One or more or all of the heat storage units preferably have a layered structure comprising different heat-resistant solid materials, in particular different heat storage materials.

As an alternative or in addition, one or more or all of the heat storage units may have one or more flow layers for influencing an inflow, throughflow or outflow of gas.

For example, a layered structure comprising different heat storage materials and/or flow materials is provided.

It may be provided for a first layer of a dense-burned ceramic material to be formed. As a result, it is possible in particular to prevent the penetration of moisture into the material, which can result in lingering odours, salt formation and clogging of the storage material.

At least one second layer is preferably formed from aluminium oxide ceramic or a similar storage material, wherein this aluminium oxide ceramic or similar material may have a higher density by volume than the material of the first layer. As a result, preferably a relatively large quantity of energy can be stored in this second layer.

For example, a third layer preferably comprises a mullite material, preferably a porous mullite material. This mullite material preferably has a reaction-accelerating action, which can be the result in particular of an increase in the surface area and traces of metals in the material.

As the fourth layer there is provided for example a bulk material of turbulence-generating materials, for example saddle-type bodies and/or balls, as a result of which optimised inflow of the reformed raw gas stream into the oxidation region and thus optimised oxidation in the oxidation region can be achieved. Furthermore, this bulk material preferably makes it possible to even out the incident flow against the clean gas flow chamber, and results in a uniform release of energy to the heat storage material therein.

In alternative embodiments of the layered structure, it is also possible to provide additional layers or to omit individual layers of those mentioned.

Further preferred features and/or advantages of the invention form the subject matter of the description below and the representation in the drawing of exemplary embodiments.

BRIEF DESCRIPTION OF THE DRAWINGS

Like or functionally equivalent elements are provided with the same reference numerals in all the Figures.

DETAILED DESCRIPTION OF THE DRAWINGS

Figure 1:
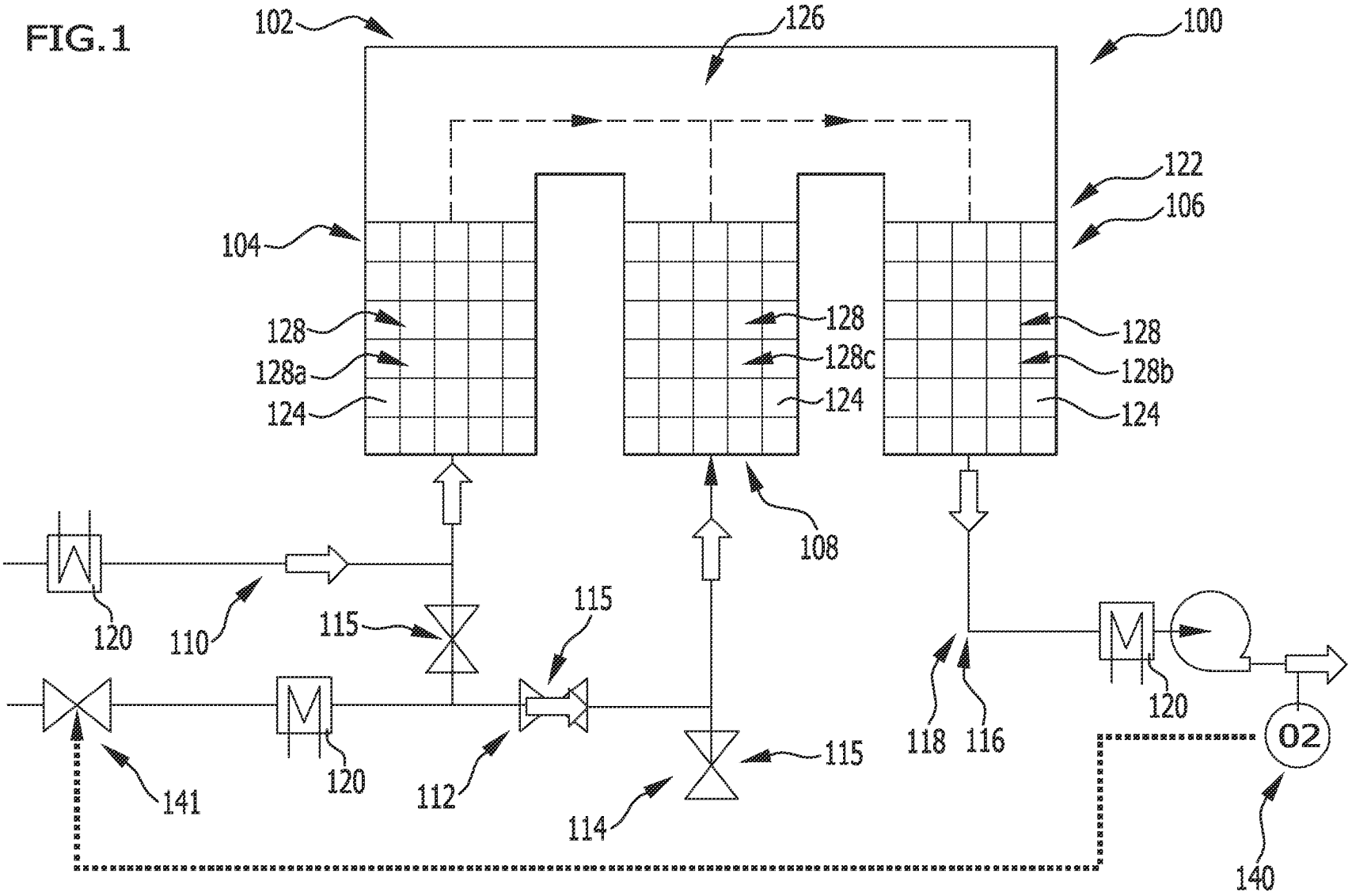
FIG. 1 shows a schematic illustration of a first embodiment of a purification device for the purification of raw gas that contains water vapour and has organic contaminants, having closed-loop control of the oxygen content in the clean gas stream.

A purification device that is illustrated in FIGS. 1 to 4 and is designated 100 as a whole is used in particular for the purification of raw gas.

The purification device 100 is particularly suitable for the purification of waste steam, which is also known as fumes or vapour.

The purification device 100 comprises in particular a regenerative thermal oxidiser 102 for the thermal conversion of odorous substances and other contaminants in the waste steam.

Preferably, the purification device 100 comprises a reforming region 104, a heat storage region 106 and a pre-heating region 108.

The reforming region 104 is configured to have the raw gas that is to be purified fed to it by means of a raw gas feed 110 of the purification device 100.

Preferably, the pre-heating region 108 is configured to have oxidising agent and/or flushing gas fed to it by way of an oxidising agent feed 112 and/or a flushing gas feed 114.

Further, there is preferably provided a clean gas discharge line 116 of the purification device 100, by way of which clean gas generated from the raw gas is dischargeable.

Thus, the clean gas discharge line 116 is in particular an exhaust gas discharge line 118 of the purification device 100.

In particular, the clean gas discharge line 116 adjoins or comprises the heat storage region 106.

A plurality of heat exchangers 120 of the purification device 100 preferably serve to heat or cool gas streams in order ultimately to optimise the energy efficiency of the purification device 100.

Moreover, there is preferably provided a heat storage device 122 of the purification device 100, by means of which the heat generated in the purification device 100 is temporarily storable and is re-usable for optimised operation of the purification device 100.

For this purpose, the heat storage device 122 comprises in particular a plurality of heat storage units 124.

The purification device 100 comprises an oxidation region 126 that adjoins the reforming region 104 and the pre-heating region 108, and opens in particular into the heat storage region 106.

In the embodiment of the purification device 100 that is illustrated in FIGS. 1 to 4, the reforming region 104, the pre-heating region 108 and the heat storage region 106 are not fixed, but are formed by different flow paths 128 of the purification device 100 in a manner varying over time, depending on the locations of feeding in the raw gas and the oxidising agent and the discharging of clean gas.

Here, each flow path 128 comprises a heat storage unit 124 of the heat storage device 122, with the result that heat is feedable to or removable from the flow paths 128, depending on the respective feed or discharge of gas.

One or more optional heating devices of the purification device 100 may contribute to optimising operation of the purification device 100, in addition to the heat storage device 122 and/or in addition to the heat exchangers 120.

Figure 2:
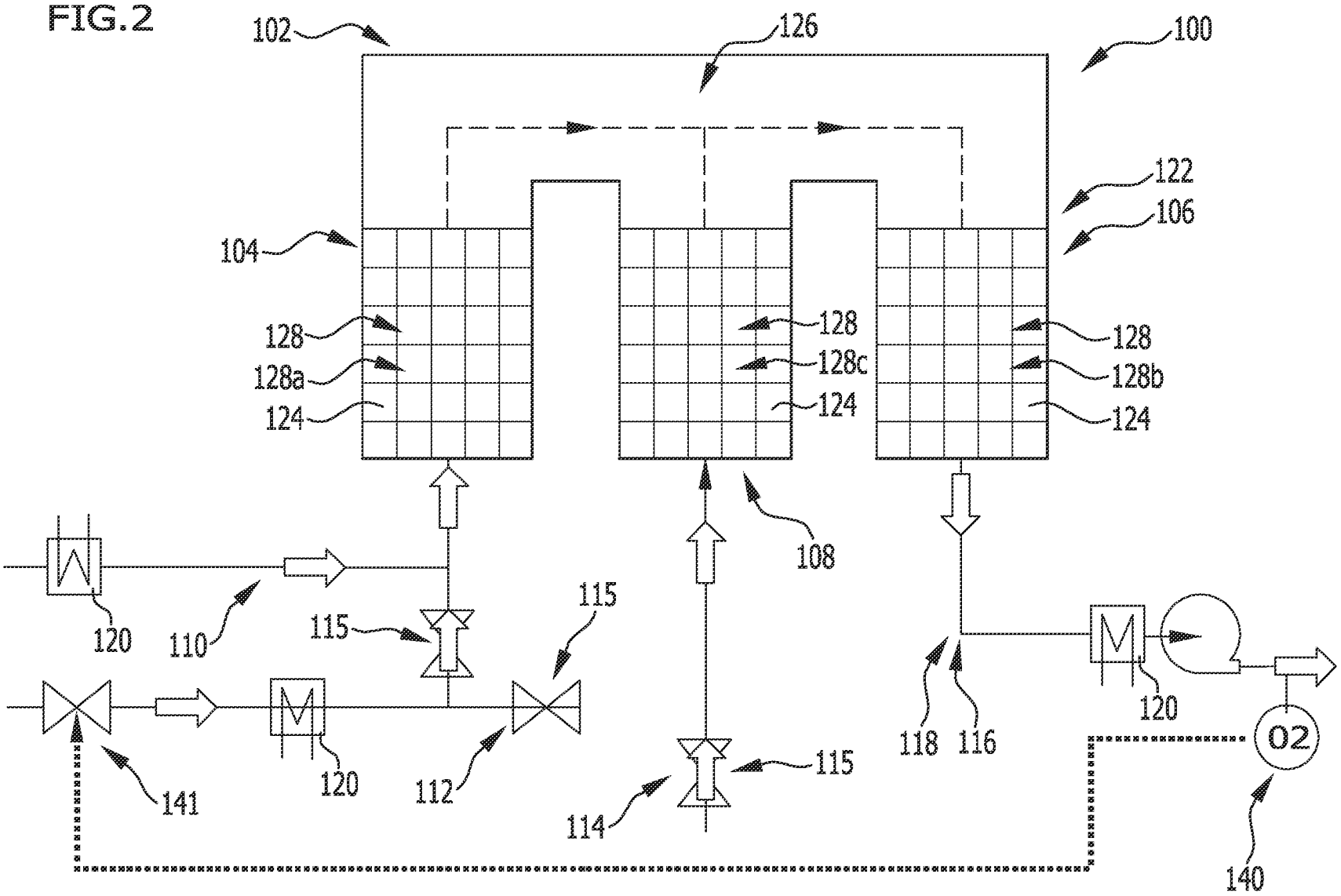
FIG. 2 shows a schematic illustration of the purification device, corresponding to FIG. 1, in a purifying and flushing mode.
Figure 3:
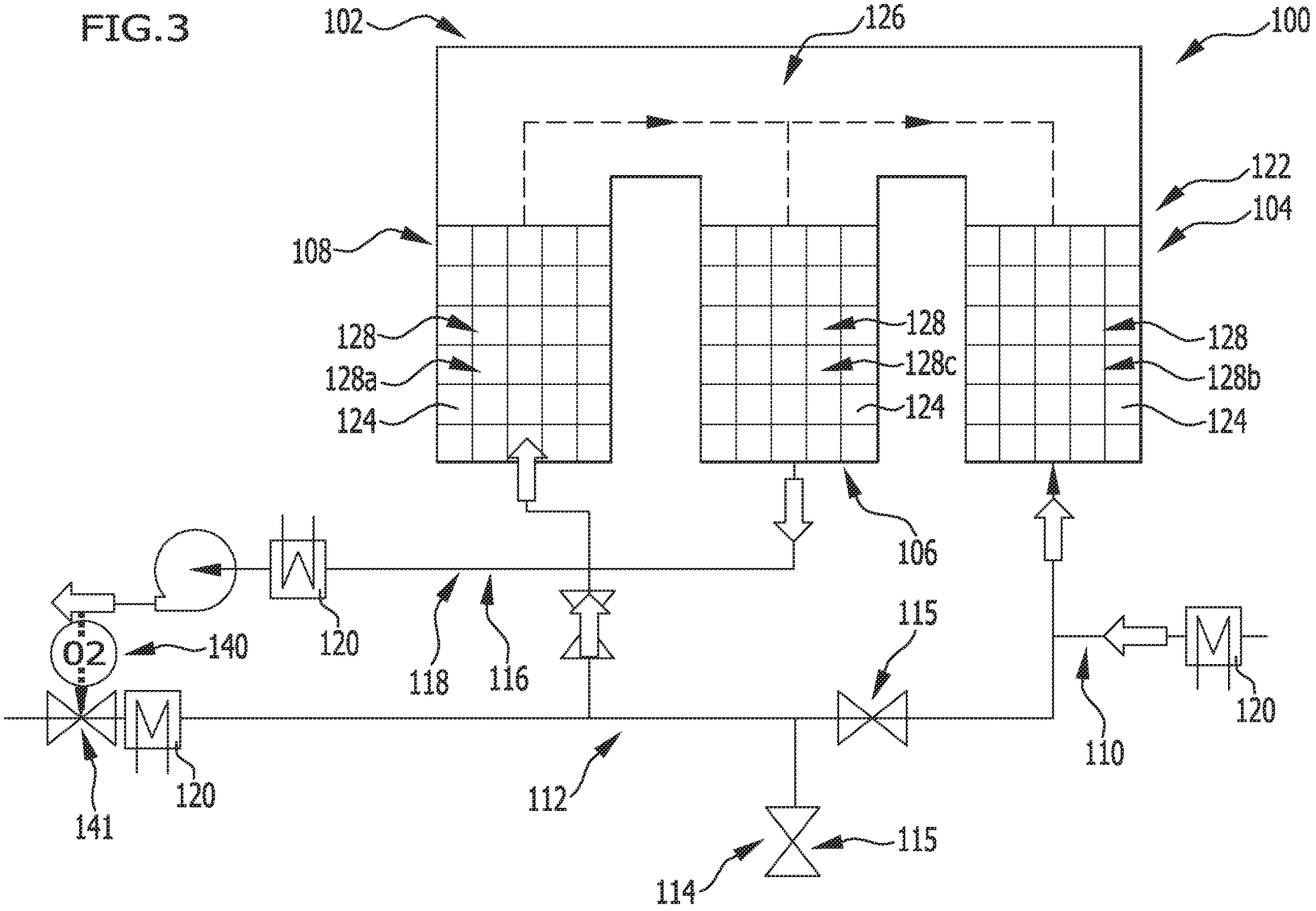
FIG. 3 shows a schematic illustration of the purification device, corresponding to FIG. 1, in the purifying mode.

As can be seen in particular from a comparison of FIGS. 2 and 3, flow along the flow paths 128 is in different directions, depending on the respective operating mode (purification mode) of the purification device 100.

For optimised use and/or heat transfer, the heat storage units 124 in the flow chambers 128 are preferably provided with a layered structure.

Figure 4:
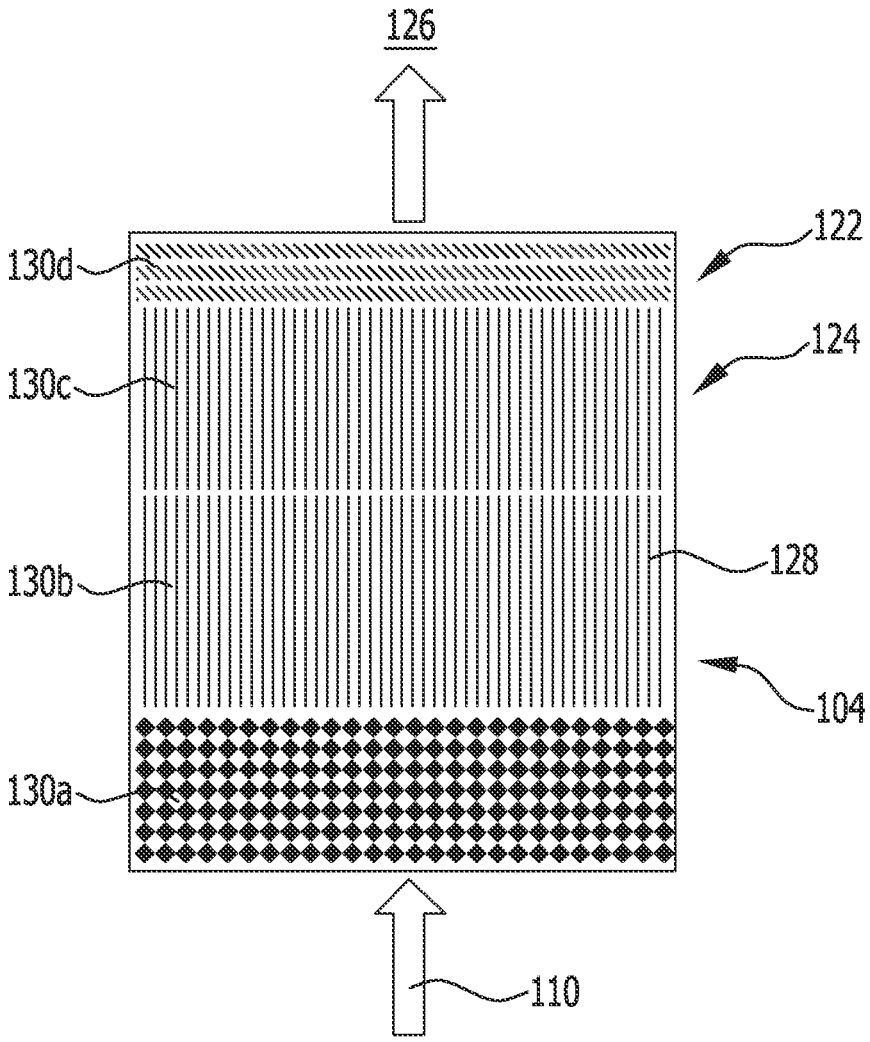
FIG. 4 shows a schematic section through the structure of a heat storage unit of a heat storage device of the purification device.

As can be seen from FIG. 4, in this case in particular optimisation of the infeed and guiding through of raw gas may be provided. For this purpose, in particular a first layer 130*a* formed for example from a dense-burned ceramic material is provided.

A second layer 130*b*, adjoining the first layer 130*a*, is preferably formed from aluminium oxide china or a similar ceramic material, and has a greater density than the material of the first layer 130*a*. As a result, a region of high heat storage capacity can be created.

A third layer 130*c*, adjoining the second layer 130*b*, comprises for example a mullite material that has a reaction-accelerating action and contributes to optimising the chemical kinetics within the flow chamber 128.

Finally, a fourth layer 130*d*, adjoining the third layer 130*c*, preferably serves to optimise inflow to the oxidation region 126, which adjoins the heat storage unit 124. For this purpose, the fourth layer 130*d* has a bulk material comprising a turbulence-generating material, for example saddle-type bodies.

During the flow of raw gas through the heat storage unit 124, illustrated in FIG. 4, the heat storage unit 124 serves as a reforming region 104 of the purification device 100.

When this same heat storage unit 124, or a further heat storage unit 124 of identical construction, is used as a heat storage region 106, the direction of flow is reversed.

The purification device 100 preferably comprises an oxidising agent sensor 140, in particular for the detection of oxygen, which, by open or closed-loop control by means of a control unit 141, controls the volumetric flow of the oxidising agent fed by way of the oxidising agent feed 112.

For the purpose of briefly flushing the oxidising agent, preferably one common or two individual switchover units 115 is/are used.

The embodiment of the purification device 100 that is illustrated in FIGS. 1 to 4 preferably functions as follows:

A raw gas, taking the form for example of waste steam, is guided by way of the raw gas feed 110 to a first flow chamber 128*a*, which forms the reforming region 104.

Arranged in this first flow chamber 128*a* is a heat storage unit 124, for example corresponding to the embodiment illustrated schematically in FIG. 4.

Before the raw gas is fed in, this heat storage unit 124 has been charged with heat such that the raw gas that is then fed in is heated by the heat storage unit 124. In particular, a temperature of at least approximately 750° C., for example at least 800° C., is achieved.

At these high temperatures, the constituent parts of the raw gas are broken down, with the result that in particular from hydrocarbons and water a reformed raw gas—for example water gas—is produced. In particular here, long-chain hydrocarbons and hydrocarbons of low volatility are to a very great extent converted to methane, carbon monoxide, hydrogen and other readily combustible substances.

The raw gas has a very low oxygen content of less than 5% by volume, in particular at most approximately 1% by volume, with the result that the readily combustible constituent parts do not oxidise in the reforming region 104 but can be conveyed on from the reforming region 104 to the oxidation region 126.

In particular here, the entire raw gas stream that has passed through the reforming region 104 is fed to the oxidation region 126 as a reformed raw gas stream.

In the oxidation region 126, the reformed raw gas stream meets a gas stream that contains oxidising agent, in particular an oxidising agent stream.

The oxidising agent stream is in particular air or an air mixture, or a process gas that contains oxidising agent, in particular containing oxygen.

The oxidising agent stream is fed by way of the oxidising agent feed 112 to a third flow chamber 128*c*. Here, care is taken that the temperature of the oxidising agent stream is at least approximately 100° C. or above, for example at least 100° C., preferably at least approximately 110° C. This preferably enables undesired condensation of water to be avoided.

The oxidising agent stream can be heated by means of an optional heating device and/or one or more heat exchangers 120. This operation is preferably a pre-heating.

Only once it is in the flow chamber 128*c* is the oxidising agent stream heated to a desired temperature so that it can be fed to the oxidation region 126. The target temperature of the oxidising agent stream here is preferably at least 750° C., for example at least approximately 800° C., in particular approximately 850° C.

This heating to the target temperature in the flow chamber 128 is in particular achieved by the third flow chamber 128*c* also having a heat storage unit 124, for example according to the embodiment illustrated in FIG. 4. This heat storage unit 124 is preferably heated before the oxidising agent stream is fed in, for example using the clean gas stream.

The oxidising agent stream preferably has an oxygen content of at least approximately 15% by volume, for example at least approximately 18% by volume, preferably approximately 21% by volume.

Bringing together the heated, reformed raw gas stream and the heated oxidising agent stream in the oxidation region 126 results in oxidation of the combustible constituent parts of the reformed raw gas stream in the oxidation region 126, as a result of which in particular hydrocarbons, carbon monoxide and hydrogen are removed from the reformed raw gas stream by oxidation, in particular giving carbon dioxide and water.

As a result, a clean gas stream is ultimately obtainable and is discharged from the oxidation region 126 through a second flow chamber 128*b*, which forms the heat storage region 106.

In the heat storage region 106, the clean gas stream emits at least some of its heat to the heat storage unit 124 arranged in the second flow chamber 128*b*. This heat storage unit 124 is preferably a heat storage unit 124 corresponding to the embodiment illustrated in FIG. 4.

After flowing through the second flow chamber 128*b* forming the heat storage region 106, the clean gas is discharged by way of the clean gas discharge line 116. By means of an optional heat exchanger 120, the quantity of heat still remaining in the clean gas may preferably be at least partly discharged from the clean gas stream and hence made useful in some other way.

The above-described purification operation of the purification device 100 (for example according to FIG. 1, which illustrates in particular normal operation) may preferably be maintained until the quantities of heat stored in the heat storage units 124 of the first and third flow chambers 128*a*, 128*c* are no longer sufficient for adequate heating of the raw gas stream and/or the oxidising agent stream, or are no longer sufficient for an adequate reaction in the reforming region 104. The point in time at which switchover is performed is preferably determined by measurement, calculation or another determination of the energy content in the flow chambers, in particular by carrying out an energy comparison of the flow chambers using a control module, for example the control module XtraBalance.

When adequate heating is no longer possible, the purification device 100 is put, preferably by means of an open-loop control device 115, into a flushing mode (see FIG. 2), in which for example by means of a flushing gas feed 114 ambient air is briefly fed to the third flow chamber 128*c*. Raw gas and flushing gas are fed to the first flow chamber 128*a*, and/or clean gas is fed to the second flow chamber 128*b*. In particular, the flushing gas, which is for example ambient air, is used to achieve cleaning of the heat storage units 124, in order ultimately to avoid an undesired emission of odorous substances or harmful gases at the time of a subsequent flow reversal.

After the flushing procedure, the raw gas is no longer fed to the first flow chamber 128*a* but for example to the second flow chamber 128*b*, which consequently is no longer the heat storage region 106 but now forms the reforming region 104 (see FIG. 3).

Finally, because of the infeed of the clean gas stream, the heat storage unit 124 arranged in the second flow chamber 128*b* has previously been heated to a high temperature and thus now forms a sufficient heat source for carrying out the reforming procedure for reforming the raw gas stream.

The first flow chamber 128*a*, which previously formed the reforming region 104, now correspondingly forms the flushing region 108, with the result that the clean gas stream generated in the oxidation region 126 is now discharged by way of the third flow chamber 128*c*.

This heats the heat storage unit 124 that is arranged in the third flow chamber 128*c* and thus prepares it for later use as a reforming region 104 or indeed as a pre-heating region 108.

In addition to the operating modes of the purification device 100 that are illustrated in FIGS. 2 and 3, numerous further operating modes may be implemented. In particular, the third flow chamber 128*c*, which in FIGS. 1, 2 and 3 forms the pre-heating region 108, is also used for guiding away/discharging the clean gas at regular intervals (see FIG. 3) and hence prepared for re-use as a pre-heating region 108 or indeed a reforming region 104.

The oxidising agent feed 112 is controlled in particular depending on an oxygen content in the clean gas stream. In particular, the quantity of oxidising agent, in particular the volumetric flow of oxidising agent and/or the mass flow of oxidising agent, is preferably controlled by open and/or closed-loop control such that reliable oxidation of the substances in the reformed raw gas stream is produced in the oxidation region 126. Performance of the appropriate closed-loop control may be for example temperature-dependent, oxygen-dependent or indeed dependent on a composition of the clean gas stream. Moreover, it goes without saying that numerous further open-loop and/or closed-loop control variables are conceivable.

Because a reformed raw gas stream is produced from a raw gas stream in the described purification device 100 before the reformed raw gas stream undergoes chemical reaction with the oxidising agent, the purification device 100 may be operated particularly simply and cost-efficiently. Moreover, additional devices such as separators and scrubbers can be avoided.

In a further development, it may moreover be provided for the clean gas stream to be fed to a condenser, in particular a heat exchanger 120 that is arranged in the clean gas discharge line 116 and takes the form of a condenser. As a result, preferably the volume of the clean gas stream can be reduced, in particular by condensing out the water vapour in the clean gas stream. Thus, a negative pressure, below the ambient pressure, can preferably be generated in the condenser, as a result of which the energy requirement for conveying the raw gas stream and the clean gas stream for the raw gas purification can be reduced.

The invention claimed is:

1. A method for purification of a raw gas stream via a purification device, the purification device including (i) a plurality of flow chambers having heat storage material and (ii) an open-loop control device, the raw gas stream containing water vapour and having organic contaminants, the method comprising:

feeding the raw gas stream to a reforming region in which contaminants in the raw gas stream react chemically with the water vapour in the raw gas stream, as a result of which a reformed raw gas stream is obtained;

feeding the reformed raw gas stream and an oxidising agent stream to an oxidation region in which constituent parts of the reformed raw gas stream react chemically with oxidising agent of the oxidising agent stream, as a result of which a clean gas stream is obtained; and switching, via the open-loop control device, the purification device between first and second purification modes, wherein, in the first purification mode, the raw gas stream is to be fed at least to a first of the flow chambers, and the clean gas stream is to be discharged, by a clean gas discharge line, from at least a second of the flow chambers; and wherein, in the second purification mode, the raw gas stream is to be fed to the at least one second flow chamber, and the clean gas stream is to be discharged, by the clean gas discharge line, from the at least one first flow chamber.

2. A method according to claim 1, wherein the raw gas stream is an organically contaminated raw gas stream that contains water vapor.

3. A method according to claim 2, wherein the organically contaminated raw gas stream containing water vapor includes exhaust vapor.

4. A method according to claim 1, wherein the raw gas stream in the reforming region and/or the clean gas stream in a heat storage region and/or the oxidising agent stream in a pre-heating region are each guided through a respective heat storage unit of a heat storage device.

5. A method according to claim 4, wherein one or more of the heat storage units are formed by or comprise ceramic flow bodies.

6. A method according to claim 1, wherein a chemical reaction in the reforming region is an allothermal and/or hydrothermal gasification, and/or in that the chemical reaction in the oxidation region is a reaction with an external source of energy and/or an autothermal oxidation.

7. A method according to claim 1, wherein a first of the flow chambers at least some of the time forms the reforming region, and wherein a second of the flow chambers at least some of the time forms a heat storage region to which the clean gas stream is fed.

8. A method according to claim 7, wherein the purification device comprises at least a third flow chamber that at least some of the time forms a pre-heating region to which the oxidising agent stream is feedable for the purpose of being pre-heated before the oxidising agent stream is fed to the oxidation region.

9. A method according to claim 7, wherein the raw gas stream and/or the clean gas stream and/or the oxidising agent stream is/are fed alternately in each case to different flow chambers, such that the respective flow chambers alternately form the reforming region and/or the heat storage region and/or the pre-heating region.

10. A method according to claim 1, wherein the raw gas stream has an oxidising agent content.

11. A method according to claim 1, wherein in the reforming region, the raw gas stream is heated to at least approximately 800° C.

12. A method according to claim 1, wherein a heat exchanger and/or a heating device is/are used to heat the raw gas stream before it is fed to the reforming region and/or to heat the oxidising agent stream before and/or after it is fed to a pre-heating region.

13. A method according to claim 1, wherein the clean gas stream is first fed to a heat storage region and then to a downstream heat exchanger, and wherein the clean gas stream is cooled by the heat exchanger.

14. A method according to claim 1, wherein the oxidising agent stream is fed to the oxidation region such that it bypasses the reforming region and/or independently of a flow path of the raw gas stream.

15. A method according to claim 1, wherein the mass flow and/or the volumetric flow of the oxidising agent stream are controlled by open and/or closed-loop control depending on a mass flow and/or volumetric flow of the raw gas stream and/or depending on a degree of contamination in the raw gas stream and/or depending on a calorific value of the raw gas stream and/or depending on an oxygen content in the clean gas stream.

16. A method according to claim 1, wherein the clean gas stream is fed to a heat exchanger.

* * * * *